United States Patent [19]

Gidley

[11] Patent Number: 4,619,323

[45] Date of Patent: Oct. 28, 1986

[54] METHOD FOR CONDUCTING WORKOVER OPERATIONS

[75] Inventor: John L. Gidley, Houston, Tex.

[73] Assignee: Exxon Production Research Co., Houston, Tex.

[21] Appl. No.: 513,876

[22] Filed: Jul. 14, 1983

Related U.S. Application Data

[62] Division of Ser. No. 270,059, Jun. 3, 1981, abandoned.

[51] Int. Cl.[4] ..... E21B 33/13; E21B 37/00

[52] U.S. Cl. ..... 166/285; 166/65.1; 166/242; 166/305.1; 166/312

[58] Field of Search ..... 166/250, 307, 308, 285, 166/305.1, 65.1, 242, 313, 189, 312; 138/111; 174/47, 70 R

[56] References Cited

U.S. PATENT DOCUMENTS

| | | | |
|---|---|---|---|
| 3,019,841 | 2/1962 | Ternow | 166/255 |
| 3,020,955 | 2/1962 | Tausch | 166/312 |
| 3,104,718 | 9/1963 | Ewing | 166/313 |
| 3,129,759 | 4/1964 | Tillman | 166/277 |
| 3,364,993 | 1/1968 | Skipper | 166/250 |
| 3,519,078 | 7/1970 | Harrison | 166/313 |
| 3,648,772 | 3/1972 | Earlougher, Jr. | 166/273 |
| 3,965,978 | 6/1976 | Conley | 166/113 |
| 4,223,727 | 9/1980 | Sustek, Jr. | 166/250 |
| 4,237,975 | 12/1980 | Scherubel | 166/308 |
| 4,256,146 | 3/1981 | Genini | 138/111 |
| 4,336,415 | 6/1982 | Walling | 174/47 |

FOREIGN PATENT DOCUMENTS

| | | | |
|---|---|---|---|
| 382807 | 2/1973 | U.S.S.R. | 166/285 |
| 783464 | 3/1980 | U.S.S.R. | 166/300 |

OTHER PUBLICATIONS

The article: "The Effects of Some Additives on the Physical Properties of Portland Cement", 1959.

Kingston, Aciding Hand Book, 5-18-1948, p. 32.

*Primary Examiner*—James A. Leppink

*Assistant Examiner*—Hoang C. Dang

*Attorney, Agent, or Firm*—John S. Schneider

[57] ABSTRACT

Apparatus for use in conducting well workover operations includes a coiled non-electrically conductive matrix shaped into a string and containing at least one conduit capable of conducting fluids and electrical conductor means capable of transmitting electrical energy through said matrix. Tool means for performing well operations is connected to the matrix string. Preferably, the matrix string contains three conduits. A variety of workover methods may be carried out using various tool means.

12 Claims, 15 Drawing Figures

METHOD FOR CONDUCTING WORKOVER OPERATIONS

This is a division, of application Ser. No. 270,059, filed June 3, 1981 now abandoned.

BACKGROUND OF THE INVENTION

The present invention relates to equipment for conducting workover operations in wells. More particularly, the invention concerns equipment containing conduits capable of conducting fluids and conductors capable of transmitting electricity in a well bore. Heretofore, it has been necessary to make two separate runs in the well bore to (a) conduct well logging or other electrical operations and (b) conduct pumping operations which require a work string. While the use of coiled tubing has expedited the running of tubing into and from the well bore, such tubing is incapable of supplying electrical power to operate downhole devices. A coiled tubing unit, therefore, which is capable of providing means for pumping into the well bore and at the same time supplying electrical power for operating sensing, signaling, logging, perforating and other electrically operable devices is capable of effecting substantial savings in time, effort and money. The composite work string of the present invention is such a unit.

SUMMARY OF THE INVENTION

Briefly, the invention concerns apparatus for conducting well workover operations comprising a structurally supported non-electrically conductive matrix shaped into a string containing one or more conduits capable of conducting fluids and electrical conductor means capable of transmitting electric current through said matrix; and tool means connected to said matrix for performing well operations.

DESCRIPTION OF THE PREFERRED EMBODIMENTS

Figure 1:
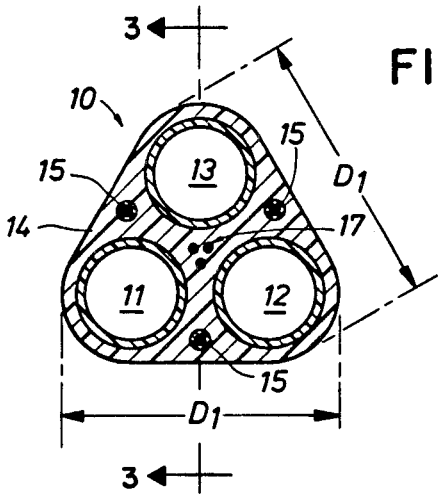
FIG. 1 is a cross-sectional view of the composite work string of the invention.
Figure 3:
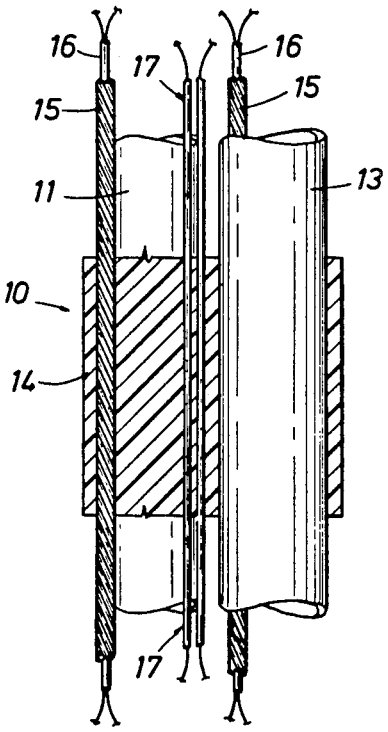
FIG. 3 is a view taken along lines 3—3 of FIG. 1.
Figure 2:
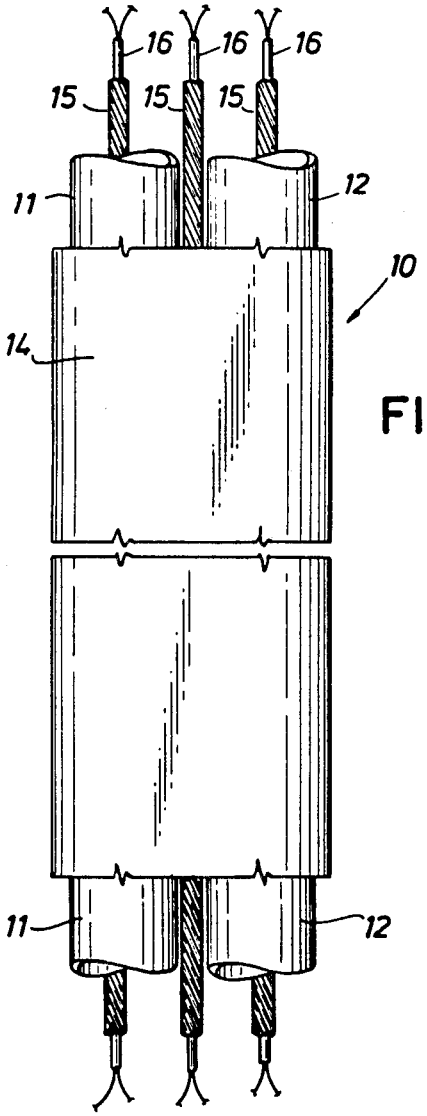
FIG. 2 is an elevational view of FIG. 1.

Referring to FIGS. 1 through 3 a composite work string, generally designated 10, includes three plastic tubes 11, 12 and 13 arranged in a triangular configuration in a plastic matrix 14 which also has a triangular configuration in cross-section. Three armor cables 15, also arranged in a triangular configuration carry electrical conductors 16 and extend through the length of matrix 14. The armor cables furnish structural strength so that the tensile strength of the matrix 14 is not itself relied upon to prevent plastic matrix 14 from being pulled apart by its own weight; e.g. when the work string is run into a maximum design depth well in which no fluid provides buoyancy to the composite work string. The armor cables, therefore, act in a sense as the suspension cables in a suspension bridge providing the principal load supporting function of the composite conduit-conductor assemblage. Sensing and signaling electrical conductors 17 also extend through the longitudinal axis of matrix 14.

Figure 4:
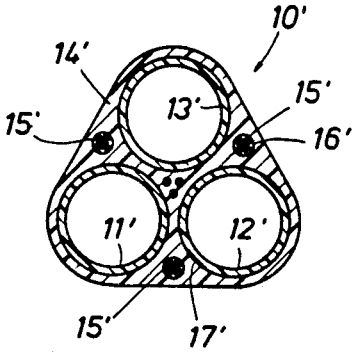
FIG. 4 illustrates a cross-sectional view of a more compact composite work string having the same outside diameter conduits as illustrated in FIG. 1.
Figure 5:
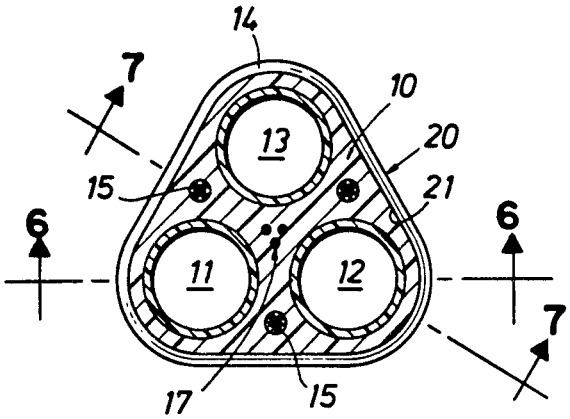
FIG. 5 illustrates a cross-sectional view of the lower end of a composite work string.

FIG. 4 illustrates a smaller matrix 14' with the same size conduits 11', 12' and 13' and the same size armor cables 15' and electrical conductors 16' and the same size sensing and signaling conductors 17'. Although the conduits are shown as being formed of different material than the matrix, the matrix could be formed with the conduits an integral part thereof.

Referring now to FIGS. 5 through 8 the lower end of composite work string 10 terminates in and is connected to a sleeve portion 21 of an operations tool housing 20 and abuts a horizontal wall member 22 connected to sleeve 21. Each of the cables 15, as shown, extends through wall 22 and is secured in place in housing 20 by a cable anchor 30*a*. Housing 20 is also formed in a triangular configuration in cross-section to conform to the triangularity of matrix 14. The lower portion of housing 20 forms a peripheral skirt member 23 which extends from wall 22. Three bores 24 extend through wall 22 and each aligns with one of the plastic conduits 11, 12 and 13. The straight portions of skirt 23 each have a thick wall portion 25 which is provided with attachment bolt holes 26. Wall portions 25 are also provided with openings 28 which are closed by removable cover plates 29.

Electrical conductors 16 connect into female connectors 30 which, as shown, are closed by removable plugs 31. Each conductor 17 connects into a female connector 32 which is closed by a plug 33.

A wash tool 40 is connected into skirt 23 and secured in place by bolts 27 extending through holes 26 and threaded into a body portion 41 of tool 40. Body 41 of tool 40 is provided with vertical bores 42 which extend upwardly from the top surface of body 41 by short conduit sections 43 each of which extends into one of the bores 24 of wall 22 of connector housing 20. As shown, the bores 42, 24 and conduits 11, 12 and 13 are aligned. Alignment of bores 42 and bores 24 are provided by slots 44 and body 41 engaging the thick wall portion 25 of skirt 23. With wash tool 40 in place a chamber 45 is formed surrounding pipes 42 between wall 22 and body portion 41. Access to chamber 45 is permitted through windows 28 to allow manual manipulation of the various electrial conductors therein.

Figure 7:
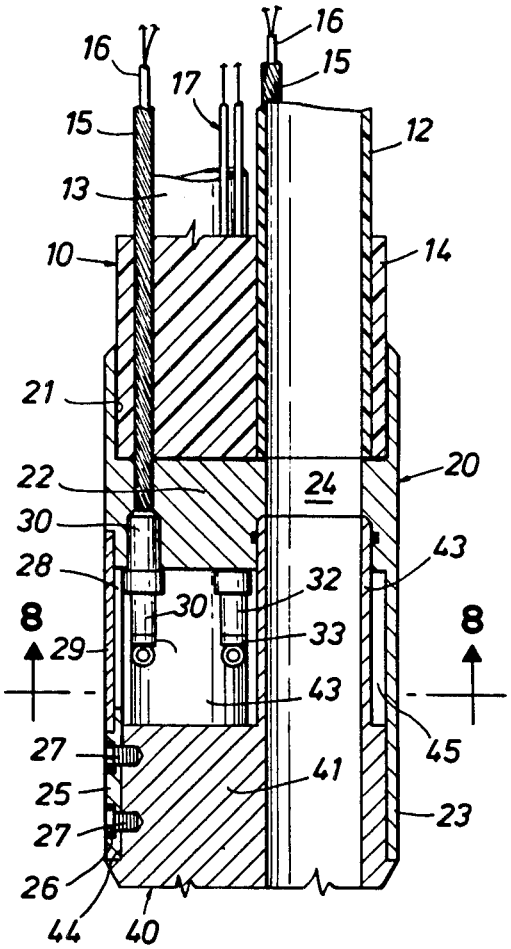
FIG. 7 is a view taken along lines 7—7 of FIG. 5.
Figure 6:
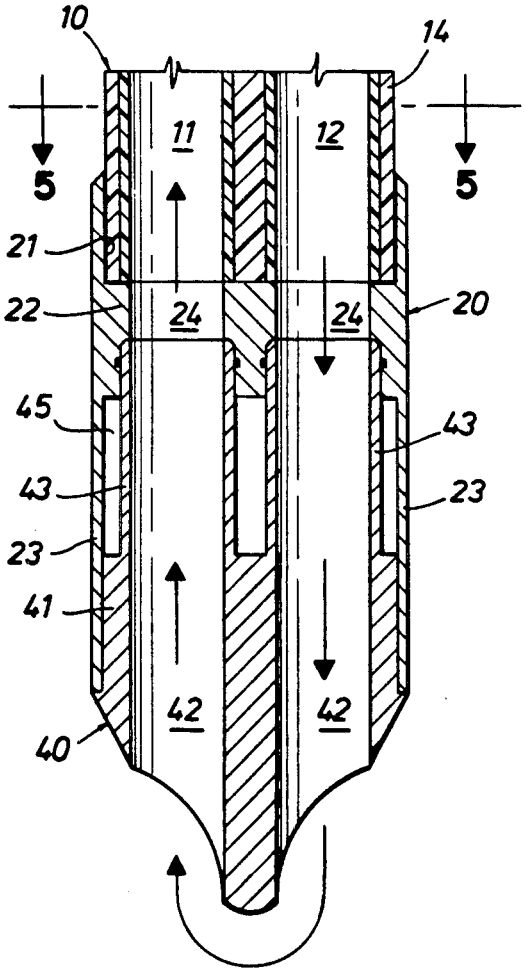
FIG. 6 is a view taken along lines 6—6 of FIG. 5.

The arrowed lines in FIG. 6 indicate one flow path of fluids used in sandwashing operations in a well bore. In a simple sandwashing operation, the electrical components of the composite work string 10 may not be needed. Therefore, connectors 30 and 32 may be plugged off as shown in FIGS. 7 and 8.

Figure 8:
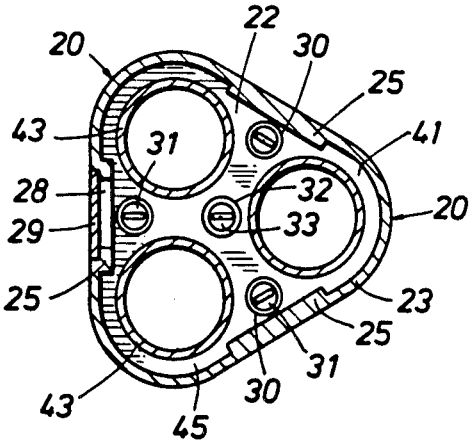
FIG. 8 is a view taken along lines 8—8 of FIG. 7.
Figure 9:
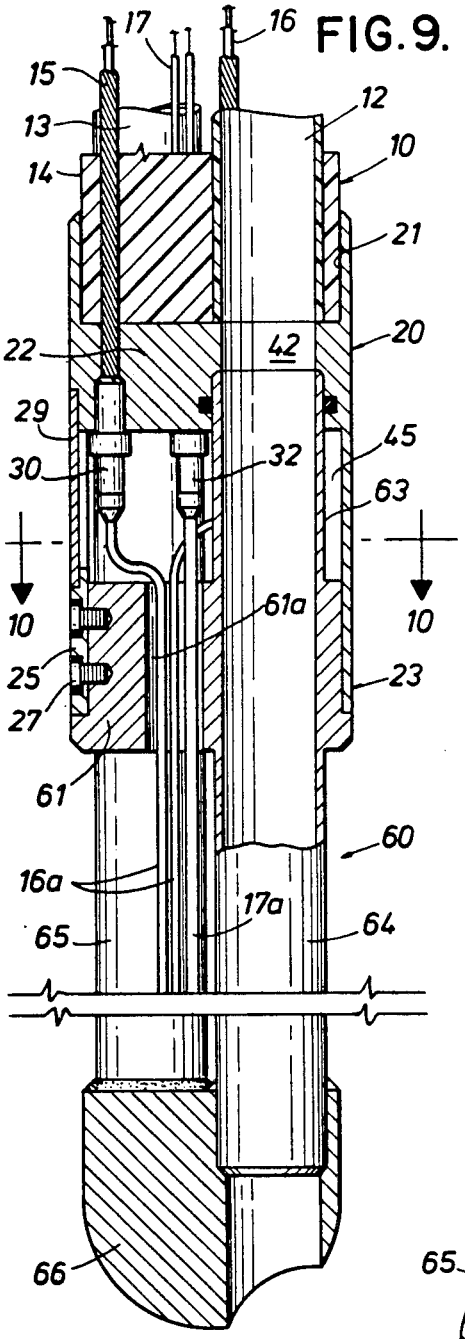
FIG. 9 illustrates a vertical sectional view of the lower end of a modified composite work string.
Figure 11:
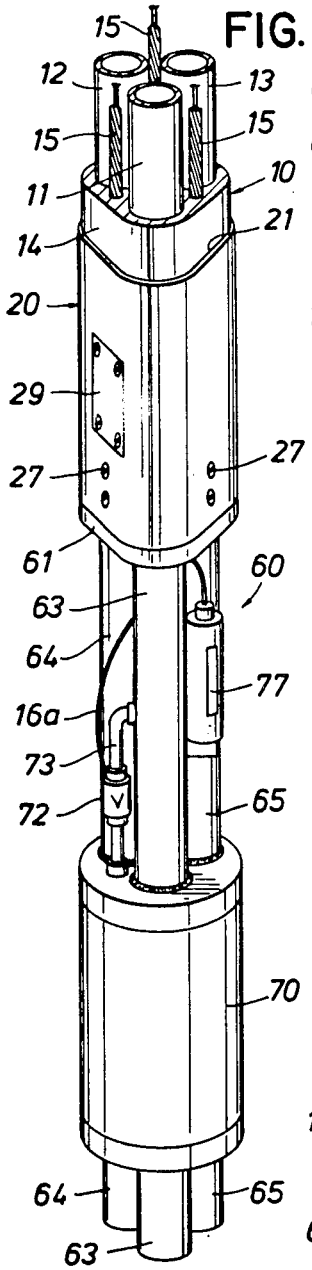
FIGS. 11 and 11A are isometric views of upper and lower sections, respectively, of another tool means attachable to a composite work string of the invention.
Figure 11A:
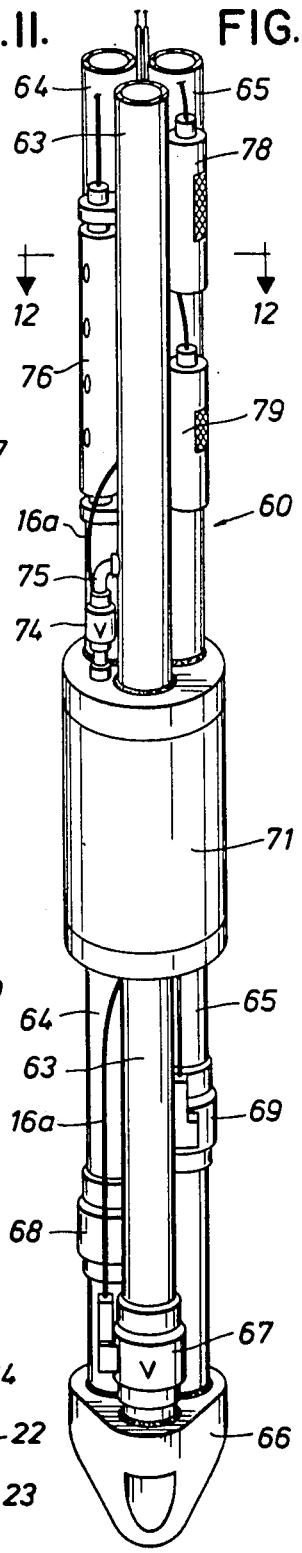
Figure 12:
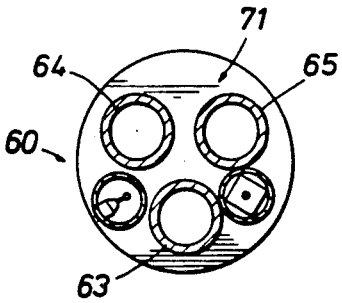
FIG. 12 is a view taken along line 12—12 of FIG. 11A.
Figure 10:
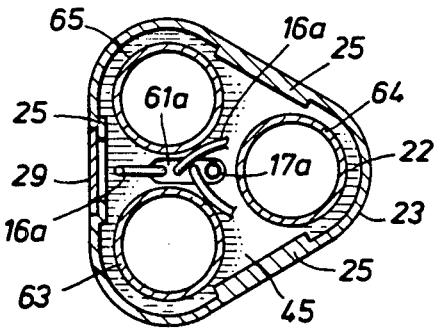
FIG. 10 is a view taken along lines 10—10 of FIG. 9.

In FIG. 9, an operations tool, generally designated 60, is attached to skirt 23 in the same manner the washing tool of FIG. 8 is attached to skirt 23. Body 61 of tool 60 has pipes 63, 64 and 65 and is provided with an opening 61*a* therethrough for the passage of electrical leads which connect to connectors 30 and 32 and to various components of the tool below body 61. A nose member 66 is connected to the lower end of pipes 63, 64 and 65. As illustrated in FIGS. 11 and 11A, flow control valves 67, 68 and 69 are positioned near pipes 63, 64 and 65, respectively, and may be solenoid operated. Mounted on tool 60 between body member 61 and valves 67, 68 and 69 are two vertically spaced apart packers 70 and 71. Each of the packers is attached to and surrounds pipes 67, 68 and 69 which extend through the packers. Packer 70 is controlled by electrically operated valve 72 and conduit 73 which fluidly communicates the interior of the packer with the bore of pipe 63. Packer 71 is similarly connected to pipe 63 by means of a conduit 75 which contains a valve 74. In this manner each packer may be operated separately or simultaneously by operating valves 72 and 74 and by fluid pressure applied in conduit 63.

The tool may also be provided with a perforator gun 76 mounted between packers 70 and 71. Other components, such as sondes 77, 78 and 79, may also be provided as desired.

The tool of FIGS. 9 through 12 may be used to detect and correct a casing leak. When tool 60 is in the hole a casing leak could be detected by a noise log. After the leak is detected cement could be squeezed into the leak after triggering the electrically set or hydraulically set packer. The setting time of the squeeze cementing slurry could be accelerated by mixing at the bottom of the hole calcium chloride water in one of the tubing strings and the squeeze cementing slurry in another string. For this purpose compositions employing a very rapid set (of say a few minutes) could be safely employed. After squeeze cementing and without moving the matrix string a pressure test could be conducted on the casing leak thus repaired.

Also, mud channels could be detected behind the well pipe. Such channels might be located with a differential temperature survey. By carrying a perforating gun on the operations tool the casing could be perforated with the perforating gun, the mud channel squeeze cemented and the repair job verified with a pressure test without moving the matrix string. Such operations would be achieved with a substantial saving in rig operating time.

The ability to set packers at will, electrically or hydraulically, makes it possible to treat individual perforations progressively and sequentially to assure complete interval coverage with such treatments as plastic sand consolidation, or well stimulation treatments such as acidizing, surfactant or solvent treatments for removing emulsions, altering wettability, dissolving paraffin, asphaltenes, or scales and conducting other remedial operations to remove production impediments.

The packer manipulation described above may be accomplished with an inflatable packer where the packer is inflated by diverting fluids into the packer inflation mechanism by means of electrically controlled valves at the tubing terminus.

Figure 13:
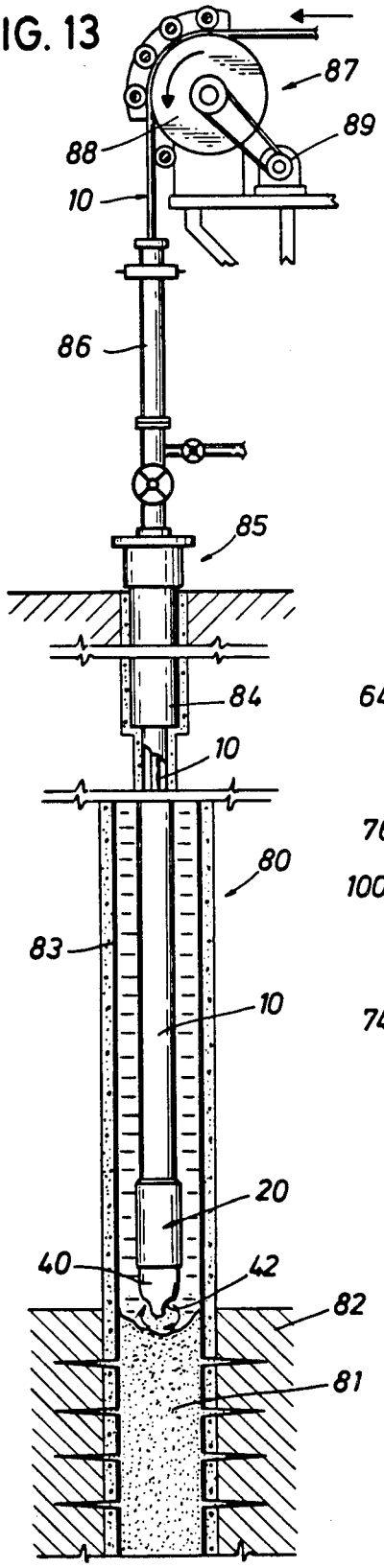
FIG. 13 illustrates washing a sand plug from a well adjacent a perforated zone.

Referring to FIG. 13 a wash tool, such as shown in FIGS. 5 through 8, is attached to the lower end of the composite work string 10 by housing 20 and run in well pipe 83 of a well bore 80 to wash out a sand plug 81 adjacent a production zone 82. The upper end of string 10 extends through a wellhead 85 (supported on a surface casing 84) and a lubricator 86. The composite work string 10 is moved vertically into the well bore by a running assembly 87 containing a drum 88 powered by a motor 89. Composite work string 10 is wound and unwound from a reel, not shown. While not shown in FIG. 13, composite work string 10 may be snubbed into well bore 80 under pressure.

Figure 14:
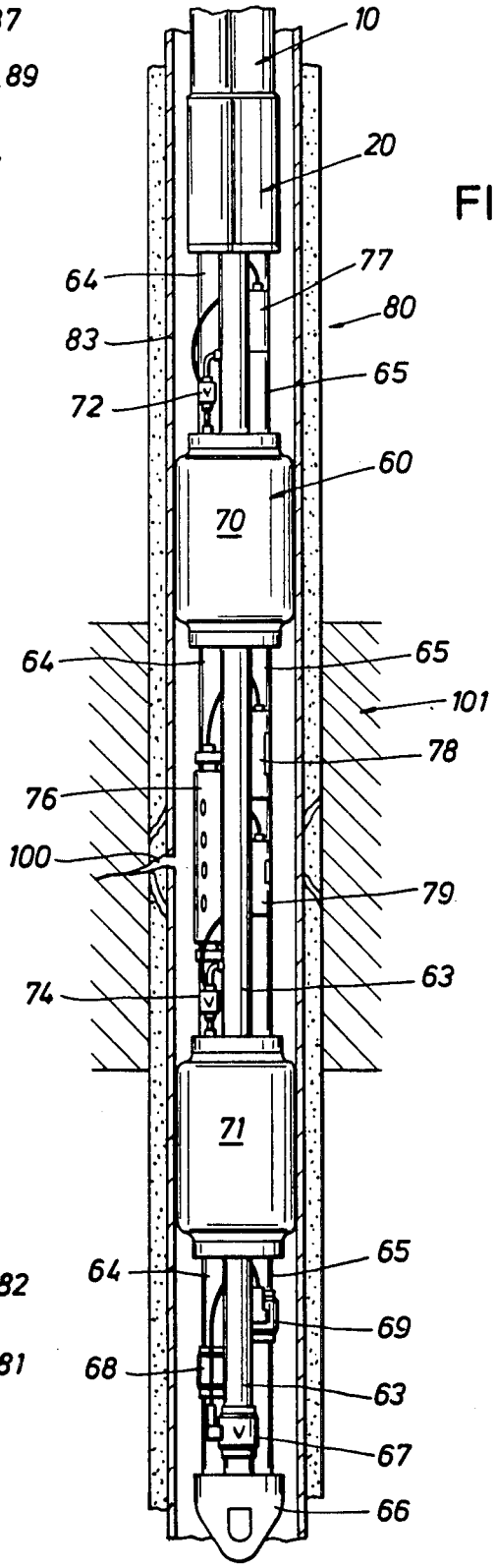
FIG. 14 illustrates still another tool means attachable to the lower end of the composite work string for conducting squeeze operations.

As illustrated in FIG. 14, tool 60 is located in well casing 83 and has detected and located a leak 100 adjacent a salt water zone 101. That zone may be repaired by squeeze cementing as described above.

The principal advantage of the invention resides in its ability to conduct simultaneously fluids and electric power to the bottom of the hole and to send and receive signals from the bottom of the hole to sense important physical properties and to direct selectively the flow of one or more fluid streams from the bottom of the work string to the well bore. Operations tools or devices that might be carried on the bottom of the composite work string are a collar locator, temperature log, differential temperature log, noise log, pressure transducer, flow meter, pH meter, conductivity meter, selective ion electrodes and many others. Typically the downhole instrument package may comprise a collar locator, a noise log, a temperature sensor, a differential temperature log, and a pressure transducer. All of such tools may be located at the terminus of the three conduit-conductor work string. A remotely operated packer may be positioned above or remotely operated packers may be positioned above and below (i.e. straddling) the instrument package (and flow ports) from the fluid conducting tubings. Electrically operated valves at the bottom terminus of each of the three tubings permit selective direction of fluid flow. All of the aforementioned tools are well known and available commercially.

The choice of three fluid conducting tubes as the preferred embodiment of the invention is based upon the need to contain high pressures in plastic tubing, an ability that decreases as tubing diameter increases. Also, the multiple conductor tubing string is desired in order to obtain physical separation of one fluid from another. It might be useful in plastic consolidation operations where the catalyst is kept separate from the resin until near or at the consolidation location or in acidizing operations where the preflush and afterflush are kept separate from the mud acid so that each might be tailored to the individual job as judged by bottomhole sensing tools as the treatment progresses.

In acidizing operations where perforation plugging is the principal production impediment, monitoring bottomhole treating pressure while injecting acid permits determining when the treatment has penetrated the perforations and established good fluid contact with the productive formation. A substantial drop in treating pressure would indicate reduction in flow resistance and would permit terminating acid injection to minimize treatment cost and to avoid the detrimental effects of too much acid. And in a fluid injection operation bottomhole pressure may be sensed both concurrent with and subsequent to injection in order to acquire transient pressure measurements to deduce formation transmissability and related reservoir properties.

Another advantage of the proposed assemblage is that the plastic matrix conduits in addition to having non-conducting properties in an electrical sense, are non-corrosive in a chemical sense. Therefore, corrosion inhibitors may be eliminated from acidizing solutions, not only to save the cost of the inhibitor but also to eliminate its detrimental effect upon the formation treated.

The composite string may have a maximum cross-sectional dimension of 1-11/16" to permit it to be operated in conventional 2⅞" production tubing with ample working clearances. Other sizes, both larger and smaller than that, might be appropriate to other production tubing or casing sizes. Larger sizes will have the disadvantage of increased bulk and will, therefore, complicate the surface handling operations in addition to increasing the weight and expense of the work string. Smaller sizes, while avoiding the two disadvantages just discussed, will be more restrictive in a hydraulic sense. Some of the time savings associated with running the work string will be lost through increased time requirements for injecting fluids because of the lower rates the additional hydraulic resistance of the smaller tubing sizes impose.

The multiple tubing configuration also has the advantage that while fluid is flowing in one direction in one tubing it may be flowing in an opposite direction in the adjacent tubing. For example, in washing sand from the bottom of the hole, it is generally desirable to avoid pumping sand up the annulus between the work string and the tubing or casing because this operation has the hazard of creating sand bridges and sticking the work string in the well bore. With the three tubing configurations shown in this invention, fluid to suspend sand could be pumped down one tubing and the sand laden fluid pumped up the other tubing without running the risk of developing sand bridges on the outside of the work string. In addition, a small tubing diameter would greatly assist the sand lifting operation.

Not only may different kinds of liquids be carried in the different tubings, but a combination of liquids and gases may be employed where desirable in certain operations. For example, in the stimulation of gas wells it may be desirable to afterflush the mud acid into the formation with nitrogen. In this case nitrogen might be carried down one tubing, mud acid down the second tubing and the regular acid preflush down the third tubing so that each of the tree stages of the mud acid treatment could be altered at will by the surface operator observing downhole pressure measurements to determine when permeability improvement has proceeded to the point where changes from one stage of the treatment to the next would be justified.

A composite work string formed of plastic and certain ultrastrong plastic braids or steel braids, such as those used in the manufacture of automobile tires, is capable of providing tubing with the required pressure capability. Plastic hose of the type usable for the composite work string of this invention is described in the Product Engineering Magazine of May 1974 in an article entitled "Hydraulic Hose Gets a Boost From Novel Plastic Technology." The tubing of the type needed is generally a composite of thermoplastic tube surrounded by a synthetic fiber braid and covered with a thermoplastic cover. An aramid ultrastrong fiber is available. It has a tensile strength of 525,000 psi and a temperature resistance up to 500° F. for short time exposures. A suitable tubing material is a polyester elastomer that is thermoplastic above 400° F. It retains considerable strength, however, in the range of 65° F. to 300° F. and, therefore, should be useful, not only for the design temperatures stated above but for lower temperatures as might be anticipated in Arctic operations. This plastic material is unique in that it does not require curing, needs no plasticizers, is resistant to swelling in oils, solvents, and hydraulic fluids, and is a non-cross-linked polymer with most of the desirable physical properties characteristic of cross-linked polymers. All of the aforementioned materials are commercially available.

While the preferred embodiment of the invention utilizes electrical power conductors contained within the structural supporting cables, such power conductors may extend through the matrix separate from the cables. Further, while separate multiple power and signal conductors are shown and described in the preferred embodiment, only two electrical leads would be required in the broadest application of the invention. Such leads would be capable of transmitting electrical power to operate a downhole tool and/or transmit sensing/signaling information.

The matrix string may have a circular or other cross-sectional configuration instead of the triangular cross-sectional configuration shown and described hereinabove.

Continuous drill string rigs are known and may be those such as described in an article "Humble's Pipe-on-Reel Service Rig Performs Well", in the *Oil & Gas Journal,* May 22, 1967, pages 140–143, and in an article "New Rig Concept Uses Continuous Drill String", *World Oil,* March 1977, pages 96 and 97.

Various other changes and modifications may be made in the illustrative embodiments of the invention shown and described herein without departing from the scope of the invention as defined in the appended claims.

Having fully described the apparatus, method of operation, advantages and objects of my invention, I claim:

1. A method for conducting workover operations in a well extending from the earth's surface comprising the steps of:

(a) positioning in said well a non-electrically conductive matrix string containing non-pumping tool means for use in conducting workover operations, said matrix string including three conduits of similar size capable of carrying fluids through said matrix string and means capable of conducting electrical power to said tool means from the earth's surface and means capable of transmitting signals through such string to the earth's surface; and (b) conducting well-treating operations through said tool means by circulating treating fluid down one of said conduits and up a second of said conduits.

2. A method as recited in claim 1 including the step of: closing off the third of said conduits by remotely operating an electrically controlled valve in said third conduit from the earth's surface.

3. A method as recited in claim 2 including the step of: closing off at a selected level in said well the space between said matrix string and a casing arranged in said well by remotely operating from the earth's surface an hydraulically-operated packer arranged on said matrix string.

4. A method as recited in claim 3 including the steps of: closing off the space between said matrix string and said casing at another level in said well by remotely operating another hydraulically-operated packer from the earth's surface; and perforating a subsurface formation located between said packers by remotely operating from the earth's surface a perforating gun located between said packers on said matrix string.

5. A method as recited in claim 1 including the steps of: detecting a casing leak by means of a noise log, the signals generated in response to said noise log being transmitted to the earth's surface through said signal-transmitting means; and pumping cement slurry down through one of said conduits into said casing leak to seal said casing leak.

6. A method as recited in claim 5 including the step of: accelerating the setting time of said cement slurry by pumping calcium chloride water through a second of said conduits and mixing said cement slurry and calcium chloride water at the location of said casing leak.

7. A method as recited in claim 1 including the steps of: determining collar locations, temperatures, noise, pressure, flow rate of fluids, PH conductivity, and ionization by means of signals transmsitted to the earth's surface through said signal transmitting means when positioning said matrix string in said well.

8. A method as recited in claim 1 including the steps of: conducting acidizing operations by injecting acid solution into said well through one of said conduits and determining pressure measurements in said well by means of a pressure transducer tool means on said matrix string during and following said acidizing operations to deduce formation transmissibility and related reservoir properties.

9. A method as recited in claim 1 including the steps of: stimulating said well by pumping nitrogen down one of said conduits, mud acid down a second conduit, and acid preflush down the third conduit and altering said three pumping operations in response to pressure measurements determined by means of a pressure transducer tool means on said matrix string.

10. A method for conducting workover operations in a well extending from the earth's surface comprising the steps of:

lowering into and positioning in said well a non-electrically conductive matrix coiled tubing string containing (a) non-pumping tool means for use in conducting workover operations, (b) a plurality of conduits of similar size capable of carrying fluids through said matrix string, (c) means capable of conducting electrical power to said tool means from the earth's surface, and (d) means capable of transmitting signals through such string to the earth's surface; and conducting well treating operations by circulating treating fluid down one of said conduits and up a second of said conduits.

11. A method as recited in claim 10 in which said tubing string is unwound from a reel as said tubing string is lowered into said well.

12. A method as recited in claim 11 in which said tubing string contains three conduits; said third conduit being closed off by remotely operating an electrically controlled valve by transmitting electrical power from the earth's surface through said electrical conductor means.

* * * * *